US005733012A

United States Patent [19]

Jones

[11] Patent Number: 5,733,012

[45] Date of Patent: Mar. 31, 1998

[54] THERAPEUTIC MEDICAL CHAIR

[76] Inventor: Robert A. Jones, 525 N. Main St. Apt. #2, Mansfield, Mass. 02048

[21] Appl. No.: 816,063

[22] Filed: Mar. 11, 1997

[51] Int. Cl.[6] ..... A47C 27/00

[52] U.S. Cl. ..... 297/452.17; 5/655.4; 297/452.22; 297/284.1; 297/452.56

[58] Field of Search ..... 297/452.17, 452.22, 297/452.56, 284.1; 5/644, 654, 655.4, 702, 911

[56] References Cited

U.S. PATENT DOCUMENTS

| | | | |
|---|---|---|---|
| 2,669,294 | 2/1954 | Burdick et al. | 297/452.22 X |
| 3,642,323 | 2/1972 | Taylor | 297/452.17 |
| 3,760,800 | 9/1973 | Staffin et al. | 128/24.1 |
| 3,766,577 | 10/1973 | Stewart | 5/12 |
| 3,840,920 | 10/1974 | Voelker | 5/348 WB |
| 3,899,210 | 8/1975 | Samhammer et al. | 297/445 |
| 4,133,064 | 1/1979 | Petrusek | 5/644 |
| 4,564,965 | 1/1986 | Goodwin | 5/453 |
| 4,577,907 | 3/1986 | Talmon | 297/452.55 X |

*Primary Examiner*—Peter R. Brown
*Attorney, Agent, or Firm*—Barlow & Josephs, Ltd.

[57] ABSTRACT

A therapeutic medical chair is provided with a chair frame for receiving a box insert having an aperture therein. The aperture receives a flexible compression bag which includes a septum to divide the bag into an upper chamber and a lower chamber. The septum includes at least one aperture therethrough to permit the migration of filler media from one chamber to the other. The gradual migration of the filler media from the upper chamber to the lower chamber gradually alters the support for a bean bag placed thereon which, in turn, gradually alters the seating of the patient to effectively prevent bed sores.

13 Claims, 10 Drawing Sheets

THERAPEUTIC MEDICAL CHAIR

BACKGROUND OF THE INVENTION

The present invention relates generally to a therapeutic medical chair for patients. More specifically, the present invention relates to a therapeutic medical chair which provides a suitable environment for the healing of existing pressure ulcers through pressure reduction and diffusion along with a gradual agitation system. In less serious cases, it can prevent pressure sores from developing on the susceptible patient.

In the field of medical patient care, it has been well known to require a patient to be completely immobilized during convalescence. In addition, certain patients, who suffer from permanent mobilizing ailments, are similarly bedridden. In general, these bedridden patients are subject to extended periods of immobility on a bed, chair, or other similar support structures. As a result of such extended mobility due to lack of movement, the patient often develops troublesome bed sores and ulcers. This is particularly true where the patient suffers from paralysis or a severe mental disease which prevents him or her from adequately moving him or herself periodically to prevent the bed sores. In general, the use of conventional hospital beds and support structures are inadequate due to the prolonged contact with the support surface. The prolonged contact at pressure points with the support surface develops these ulcers or bed sores.

Various attempts in the prior art have been made to address the common problem of bed sore development due to prolonged periods of patient immobilization. For example, U.S. Pat. No. 4,564,965, issued to Goodwin and incorporated herein by reference, discloses a fluidized patient support system which includes an oval tank and a perforated plate received in the tank, a diffuser board and a mass of granular material received on the diffuser board where fluid pressure is introduced into a chamber which diffuses through the diffuser board to fluidize the granular material to a predetermined height which provides a fluidized patient support. Similarly, U.S. Pat. No. 3,760,800, issued to Staffin et al. and incorporated herein by reference, discloses a fluidotherapy apparatus with gas-fluidized solids. The Staffin et al. patent includes a quantity of sand, or the like, which is agitated by passing air or other gas therethrough to create a pseudo-fluid which exhibits many of the characteristics of a true fluid to treat the patient. In general, the entire body of the patient may be treated during immobile periods.

These prior art support structures typically include material, such as sand, to support the patient during immobility. These fluid support structures quickly and easily conform to the body shape of the patient for optimal treatment and support. Common hospital beds also conform to the body of the patient as they typically include springs and/or foam to provide the cushioning. These prior art patient support systems are completely inadequate to address the concern over bedsores during the course of the day for a patient who is permanently immobilized or is typically immobilized for extended periods throughout the day.

Common bed support structures do not address the concern over bedsores and the fluid therapy structures of the prior art, as discussed above, are not conducive to widespread and continued use throughout a hospital. These fluid therapy machines require electricity and are quite large in size and do not resemble actual furniture. As a result, these are true treatment devices and are, therefore, not appropriate for long term care facilities where it is intended for the patient to sit outside of his or her room for periods throughout the day. For example, in such a long term care facility, the immobilized patient will be removed from his or her bed in the morning and placed in a chair for several hours to watch television or the like. In such a situation, the aforementioned bed sores are of serious concern.

Due to the demand for a patient support system which can prevent bed sores, it is desirable for a patient chair to be provided which requires no electricity, can resemble a standard piece of furniture, can be manufactured at low cost and easily maintained by the hospital staff. It is particularly desirable for the therapeutic medical chair to be extremely comfortable for the patient yet provide enough agitation to prevent bed sores.

SUMMARY OF THE INVENTION

The present invention preserves the advantages of prior art therapeutic medical chair devices for immobilized patients. In addition, it provides new advances not found in currently available devices and overcomes many disadvantages of such currently available devices.

The invention is generally directed to a novel and unique therapeutic medical chair with particular application in assisting in the healing of or preventing the development of pressure sores on patients who are immobilized. The therapeutic medical chair of the present invention enables the simple, easy and inexpensive assembly, use and maintenance of a therapeutic medical chair while providing a controlled, gradual support agitation to prevent the patient from developing bed sores.

The preferred embodiment of the present invention includes a chair frame having a bottom support surface and an insert box member disposed on the support surface where the insert box includes a top wall defining an aperture extending downwardly through the top wall and through said insert box. A flexible compression bag, having a top and bottom, is provided. A septum is disposed within and connected to the flexible compression bag so as to divide the flexible compression bag into an upper chamber and a lower chamber. The septum includes at least one aperture therethrough. A number of substantially spheroid members are freely movable within the upper chamber and the lower chamber. The spheroid members are capable of migrating from the upper chamber to the lower chamber as well as from the lower chamber back to the upper chamber via the aperture provided through the septum. A flange member is affixed to and extends out from the flexible compression bag, the flange is positioned about the periphery of the flexible compression bag and substantially along the lateral center line of the flexible compression bag. A stop member is provided in the insert box so as to extend laterally into the aperture and at a position longitudinally approximately at half of the depth of the aperture. The flange member removably rests on the stop member to longitudinally position the flexible compression bag within the aperture. A bean bag assembly is positioned on the compression member and constrained by the chair frame, the bean bag contains a volume of flowable substantially spheroid filler media.

In operation, the insert box is placed on the support surface of the chair frame. The flexible compression bag is then placed into the aperture of the insert box with its flange resting on the stop member residing in the insert box. As a result, the downward travel of the flexible compression bag is controlled. The upper chamber of the flexible compression member resides above the stop member while the lower chamber of the flexible compression member resides below the stop member. It is preferred that the entire volume of filler media within the flexible compression bag first reside entirely within the upper chamber above the septum. The flexible compression bag is then inserted into the aperture in the insert box. The bean bag cushion is then placed over the flexible compression bag to be bounded by the back support and the frame arms. The patient is then placed onto the bean bag cushion and moved into the desired comfortable location. Upon exertion of a force onto the bean bag cushion via the weight of the patient, the flexible compression bag will then begin to compress thus forcing the filler media residing within the upper chamber to slowly and gradually be forced through the septum aperture into the lower chamber. Over time, all or substantially all of the filler media will migrate from the upper chamber down through the septum aperture into the lower chamber. This migration causes the contour and configuration of the flexible compression bag to gradually change over time thus causing the shape and configuration of the bean bag cushion to change over time. As a result, the patient is moved slightly over time providing a gradual agitation over time to successfully avoid and prevent bed sores.

It is therefore an object of the present invention to provide a therapeutic medical chair that can prevent bed sores from developing on an immobilized patient.

Another object of the present invention is to provide a therapeutic medical chair which can be simple and easy to use and maintain by hospital staff yet still provide effective bed sore prevention.

It is a further object of the present invention to provide a therapeutic medical chair that is inexpensive to produce and maintain by use of non-electrical methods for patient agitation.

It is yet a further object of the present invention to provide a therapeutic medical chair which has the appearance of normal hospital furniture while still providing effective bed sore prevention capabilities.

It is another object of the present invention to provide a therapeutic medical chair which is rugged, sturdy and easy to clean.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
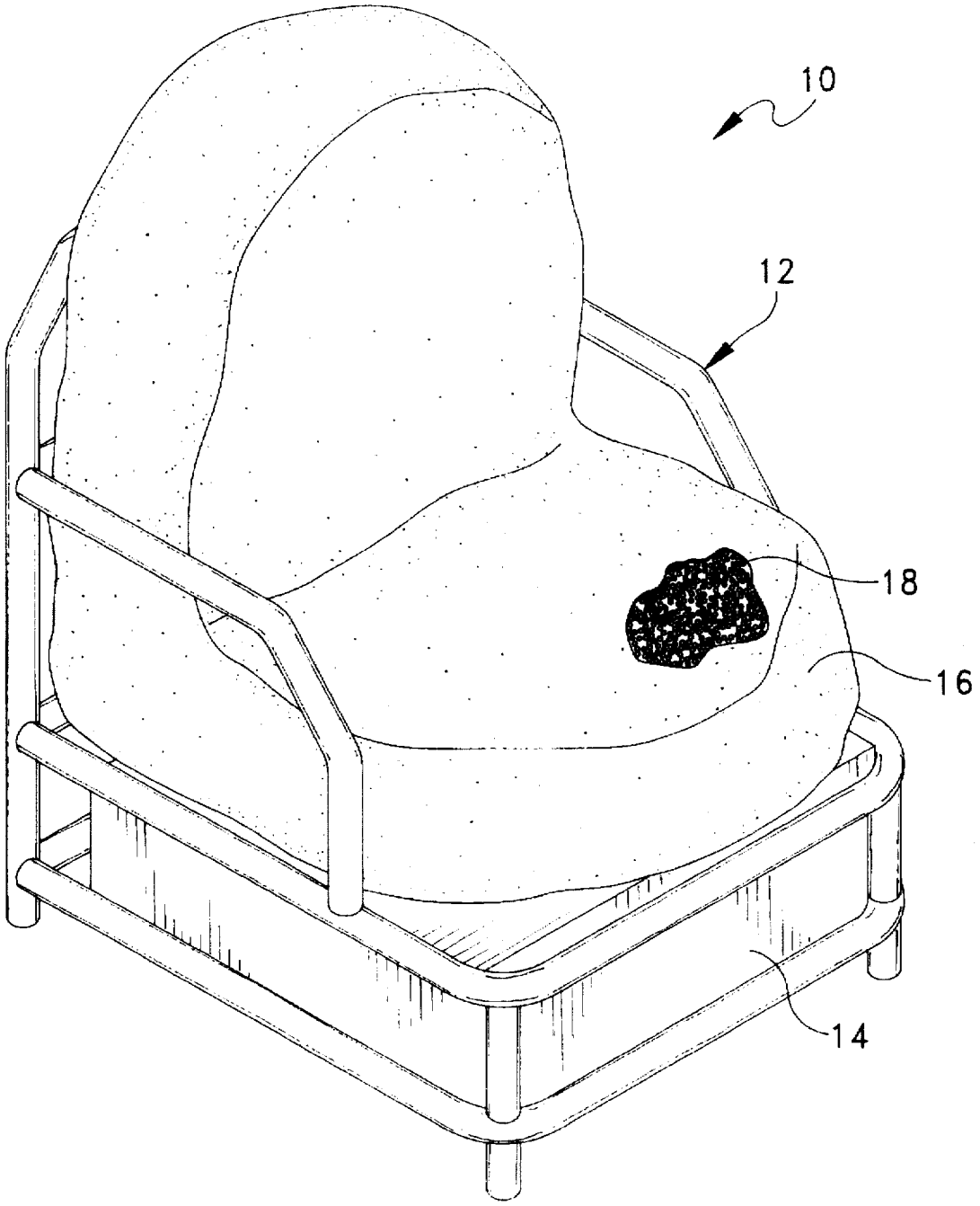
FIG. 1 is a perspective view of the therapeutic medical chair of the present invention.
Figure 2:
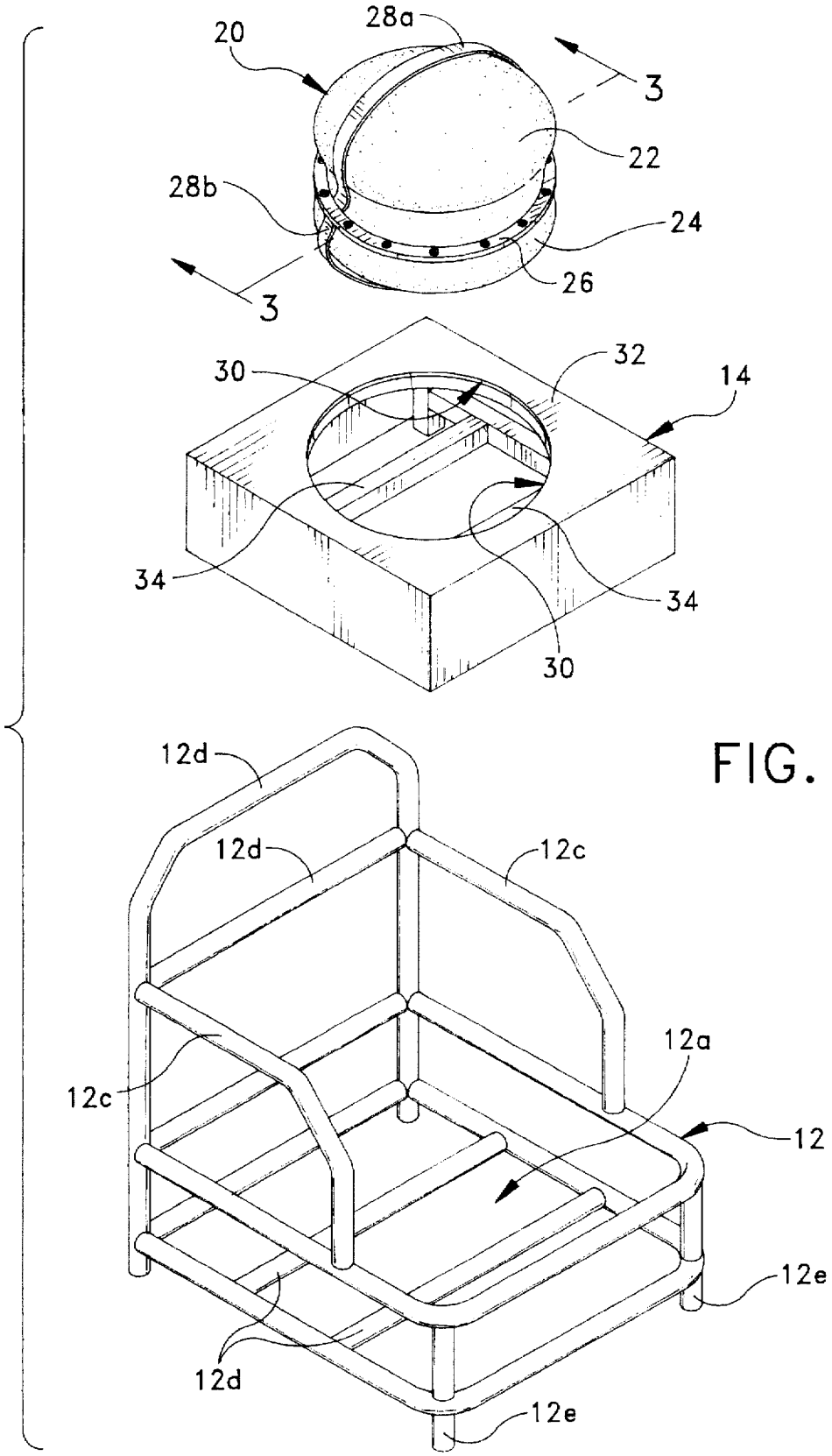
FIG. 2 is an exploded perspective view of the therapeutic medical chair of the present invention with bean bag removed.

Referring to FIG. 1, the therapeutic medical chair 10 of the present invention is generally shown to include a chair frame 12 which houses box insert 14 and contains bean bag 16. In general, the therapeutic medical chair 10 shown in FIG. 1 resembles an ordinary piece of hospital furniture as opposed to an elaborate treatment device. Referring now to FIG. 2, an exploded perspective view of the therapeutic medical chair 10 with bean bag 16 removed, is shown. A chair frame 12 is provided with box insert receiving area **12*a*, bottom supports 12*b*, arms 12*c*, back supports 12*d* and legs 12*e*. Box insert 14, which will be described in more detail below, slideably fits within box insert receiving area 12*a* and supported from below by bottom supports 12*b*. Box insert 14 includes a preferably circular aperture 30 through top wall 32 as well as an internal framework to provide stop members 34. Flexible compression bag 20 resides within top wall aperture 30 while resting on stop members 34**.

Flexible compression bag 20 includes upper half 22 and lower half 24 as well as a peripheral flange 26. Upon insertion of flexible compression bag 20 into top wall aperture 30, peripheral flange 26 abuts against stop members 34 to prevent further downward travel of flexible compression bag 20 through top wall aperture 30. Further, upper strap **28*a* is connected to upper half 22 and lower strap 28*b* is connected to lower half 24 to facilitate removal of flexible compression bag 20 from within top wall aperture 30 in box insert 14. As shown in FIG. 2, upper strap 28*a* facilitates the removal of flexible compression bag 20 when upper half 22 is positioned above lower half 24. As will be discussed below, flexible compression bag 20 may be later inverted which necessitates the use of lower strap 28*b* when lower half 24 is positioned above upper half 22** in the inverted condition.

Figure 3:
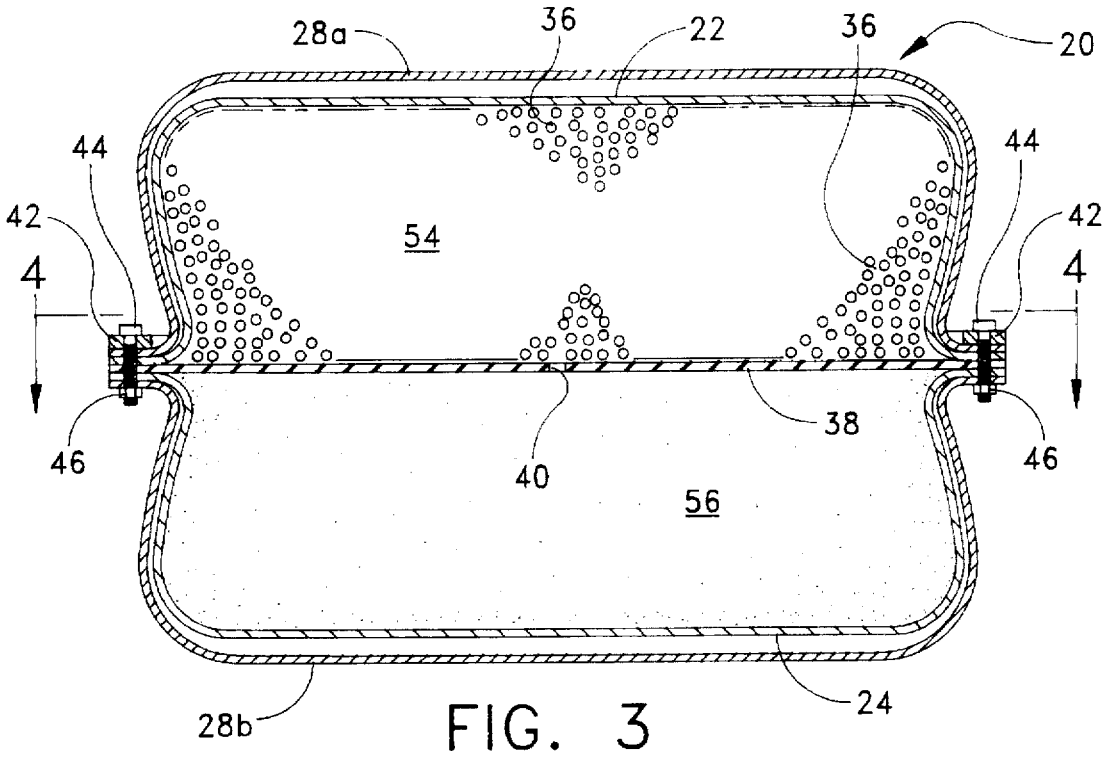
FIG. 3 is a cross-sectional view through the line 3—3 of the flexible compression bag of FIG. 2.
Figure 4:
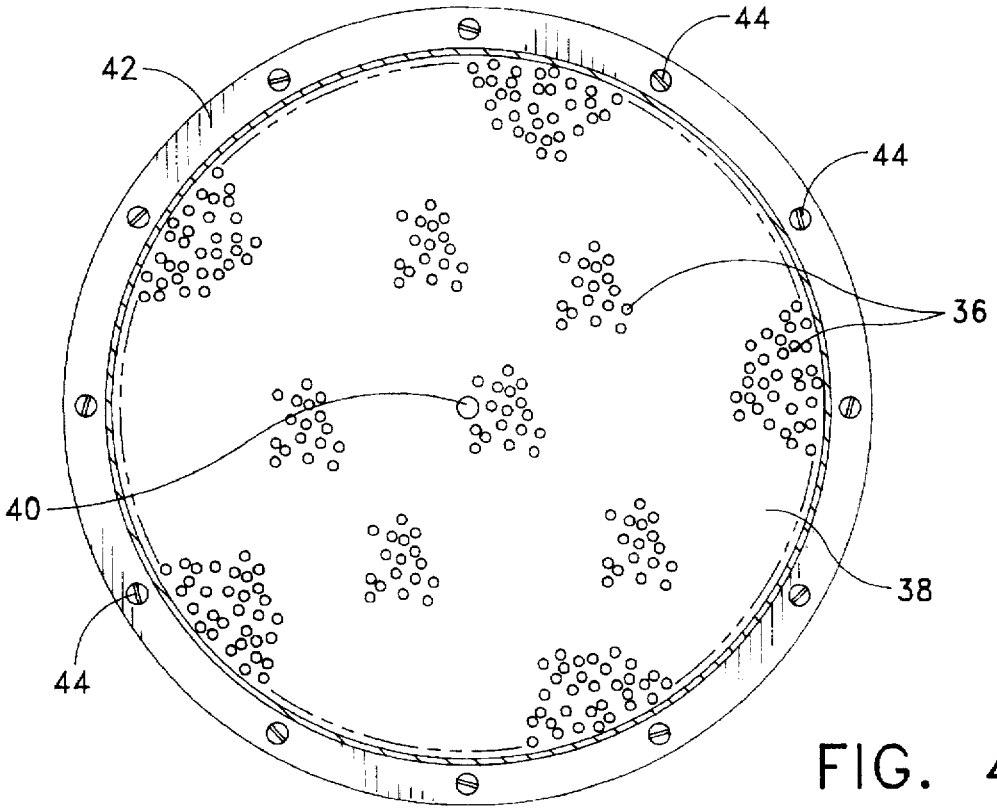
FIG. 4 is a cross-sectional view through the line 4—4 of FIG. 3.

Turning now to FIG. 3, a cross-sectional view through the line 3—3 of FIG. 2 is shown. The construction of the flexible compression bag 20, as can best be seen in FIGS. 3 and 4, is shown to include upper half 22 mated and connected to lower half 24 via bolts 44 and nuts 46. Sandwiched between upper half 22 and lower half 24 is septum 38 which divides the flexible compression bag 20 into an upper chamber 54 and a lower chamber 56. Septum 38 preferably includes a single aperture 40 at its center to provide a through-path for the migration of filler media 36 from upper chamber 54 to lower chamber 56. Septum 38 may be made of plastic or other like material and may, additionally, include more than one aperture 40 therethrough or even an array of apertures 40.

Also mounted to the connection seam between upper half 22 and lower half 24 is a rigid flange ring 42 which is preferably positioned about the entire periphery of flexible compression bag 20. The particular construction of FIGS. 3 and 4 are the preferred construction of the present invention; however, other structures may be employed to carry out the invention. For example, the flexible compression bag may be a unitary bag structure which is crimped at its midway point to receive flange ring 42. Alternatively, a flange portion may be created about the periphery of flexible compression bag 20 by rigifying a portion about the periphery of the flexible compression bag. In addition, more than one septum aperture may be provided, such as an array of apertures, to accommodate various applications and desired migration speeds. Further, the filler media 36, within flexible compression bag 20, may be granular material or plastic balls; however, various other types and sizes of filler media may be employed to accommodate different applications.

Figure 5:
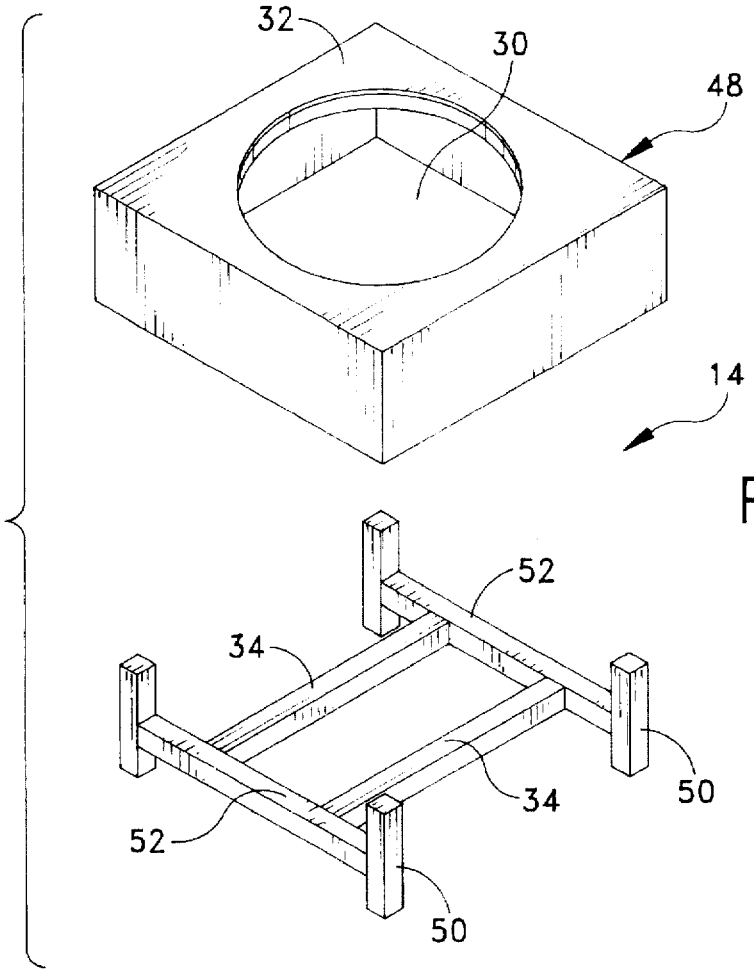
FIG. 5 is an exploded perspective view of the box insert of the present invention.
Figure 6:
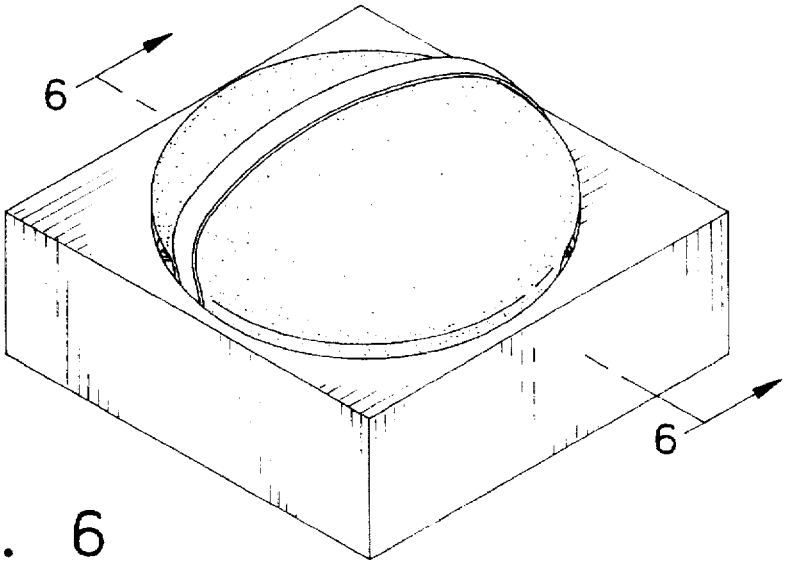
FIG. 6 is a perspective view of the flexible compression bag residing in the box insert in accordance with the present invention.
Figure 7:
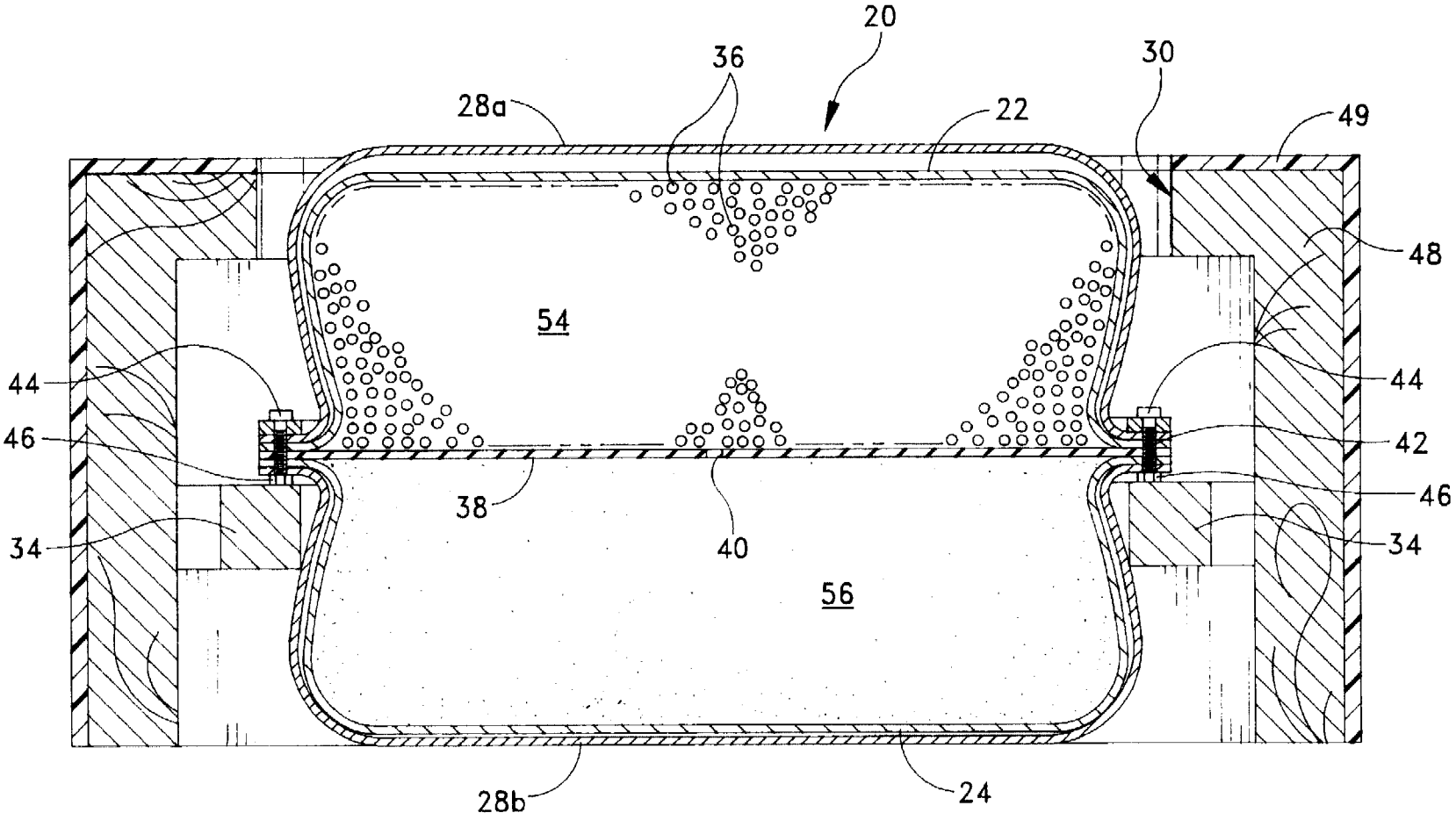
FIG. 7 is a cross-sectional view through the line 7—7 of FIG. 6 showing the entire volume of filler media within the upper chamber of the flexible compression bag.

An exploded perspective view of box insert 14 of the present invention is shown in FIG. 5. A box cover 48 is provided with a top wall 32 with top wall aperture 30 therethrough. Box cover 48 resides over a frame structure which includes upstanding legs 50, cross-members 52 and stop members 34. The box insert 14, including stop members 34, may be molded into a unitary body. As shown in FIG. 6, flexible compression bag 20 resides within top wall aperture 30 and is prevented from further downward travel by the communication of peripheral flange 26 with stop members 34. Such communication is best seen in FIG. 7. Box cover 48, which preferably includes plastic layer 49, resides over the internal framework including stop members 34. Flexible compression bag 20 resides within top wall aperture 30 with the structure defined by flange ring 42 abutting against stop members 34. This reinforced portion, which includes flange ring 42, bolts 44 and nuts 46 rest on stop members 34 to position upper chamber 54 above stop members 34 and to retain lower chamber 56 below stop members 34.

Figure 8:
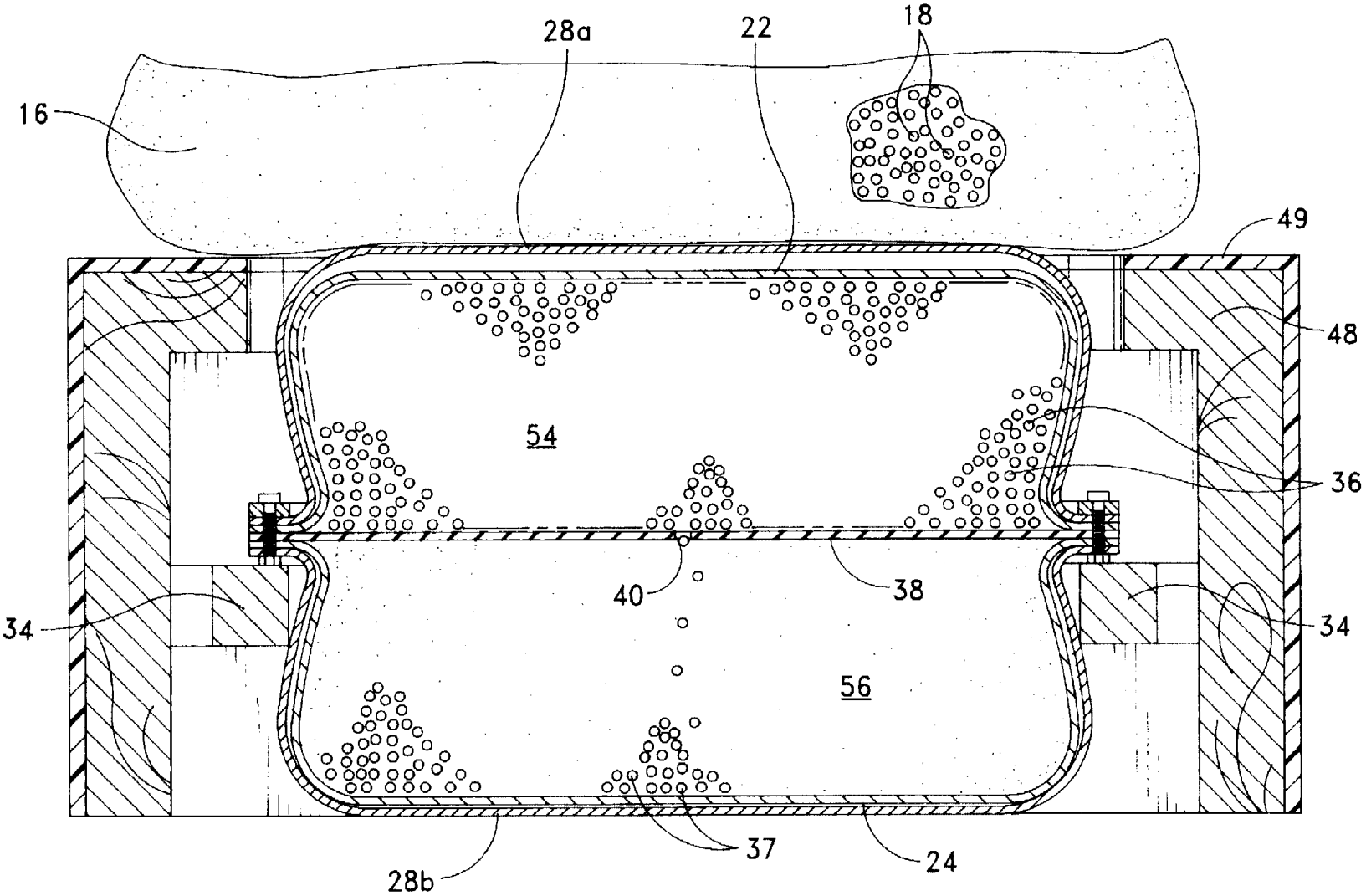
FIG. 8 is a cross-sectional view through the line 7—7 of FIG. 6 showing the migration of filler media from the upper chamber to the lower chamber.
Figure 9:
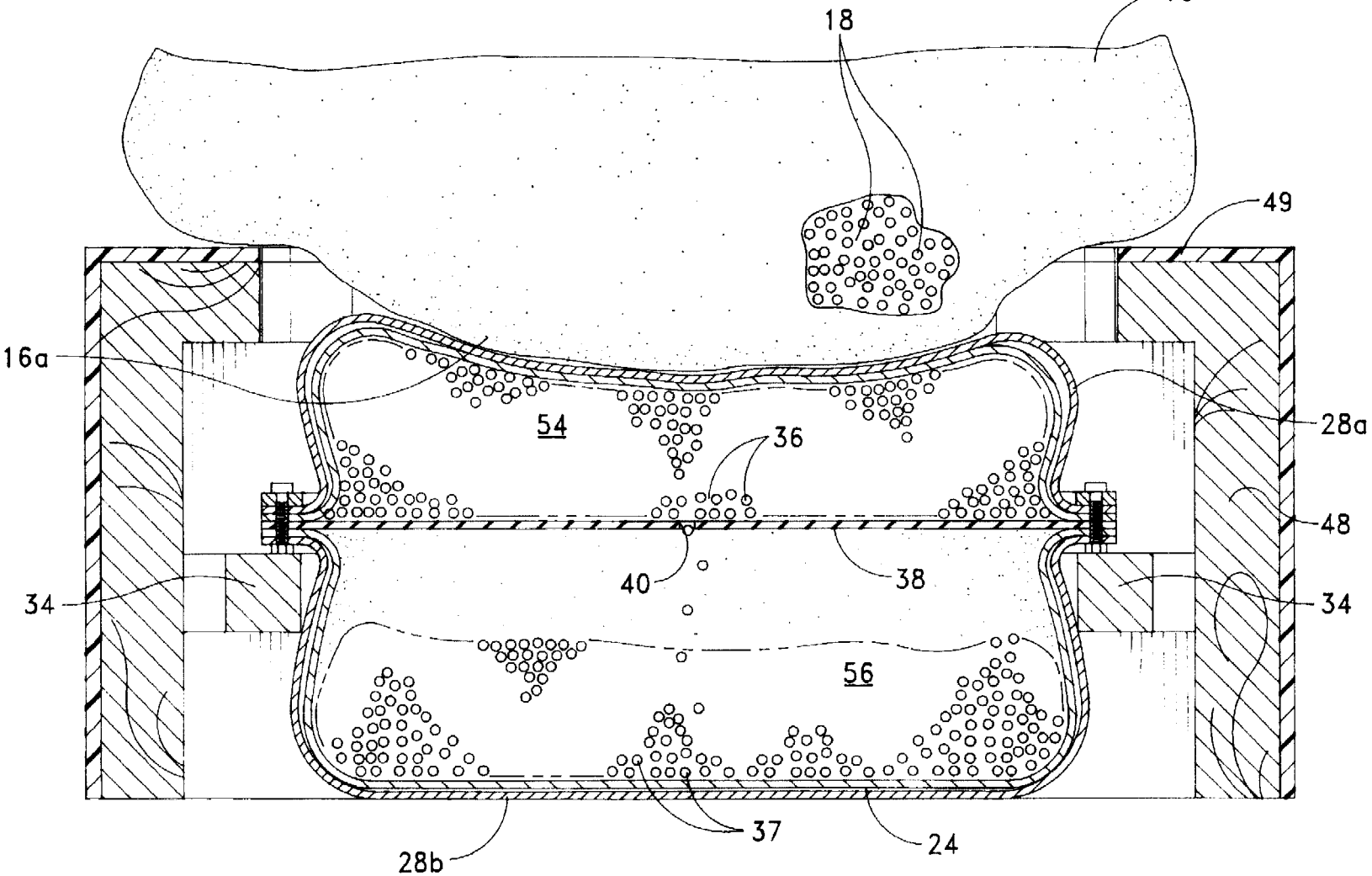
FIG. 9 is a cross-sectional view through the line 7—7 of FIG. 6 showing the substantial completion of the migration of filler media from the upper chamber to the lower chamber of the flexible compression bag.

In accordance with the present invention, bean bag 16 is placed over box insert 14 to be constrained by chair frame 12. As shown in FIG. 8, bean bag 16, with bean bag filler media 18 residing therein, is placed directly on top of upper half 22 (with upper strap **28*a* residing therebetween). When a patient is placed onto bean bag 16 for sitting, the force created by the weight of the patient decreases the volume of upper chamber 54 thus urging filler media 36 in a downward direction and through septum aperture 40. Over time, the continued exertion of pressure onto upper half 22 will continue to urge filler media 36 through septum aperture 40 until all or substantially all of filler media 36 has migrated into lower chamber 56 as seen in FIG. 9. This passage of time and the migration of filler media 36 into lower chamber 56 causes flexible compression bag 20 to compress thus deforming as a support for bean bag 16. Since the support for bean bag 16 is gradually collapsing due to the migration of filler media 36, the shape and contour of bean bag 16** also gradually changes thus gradually moving and agitating the support surface on which the patient rests. This gradually changing support surface significantly reduces the development of bed sores on the patient.

The complete migration of filler media 36 from upper chamber 54 to lower chamber 56 can take up to several hours depending on the type and size of filler media 36 used and the number of septum apertures 40 provided. After all of the filler media 36 has migrated, the bean bag 16 is removed from the top of the box insert 14 to expose the flexible compression bag 20. The flexible compression bag 20 is then removed from within top wall aperture 30 with the assistance of upper strap **28*a*. The entire flexible compression bag 20 is then inverted so that the lower chamber 56, which now houses all of the filler media 36, now serves as an upper chamber above stop members 34. Upon migration of the filler media 36 a second time, strap 28*b* is used to assist the removal of flexible compression bag 20 from box insert 14**. The flexible compression bag is then inverted again and the entire process is repeated as long as bed sore prevention is required.

Figure 10:
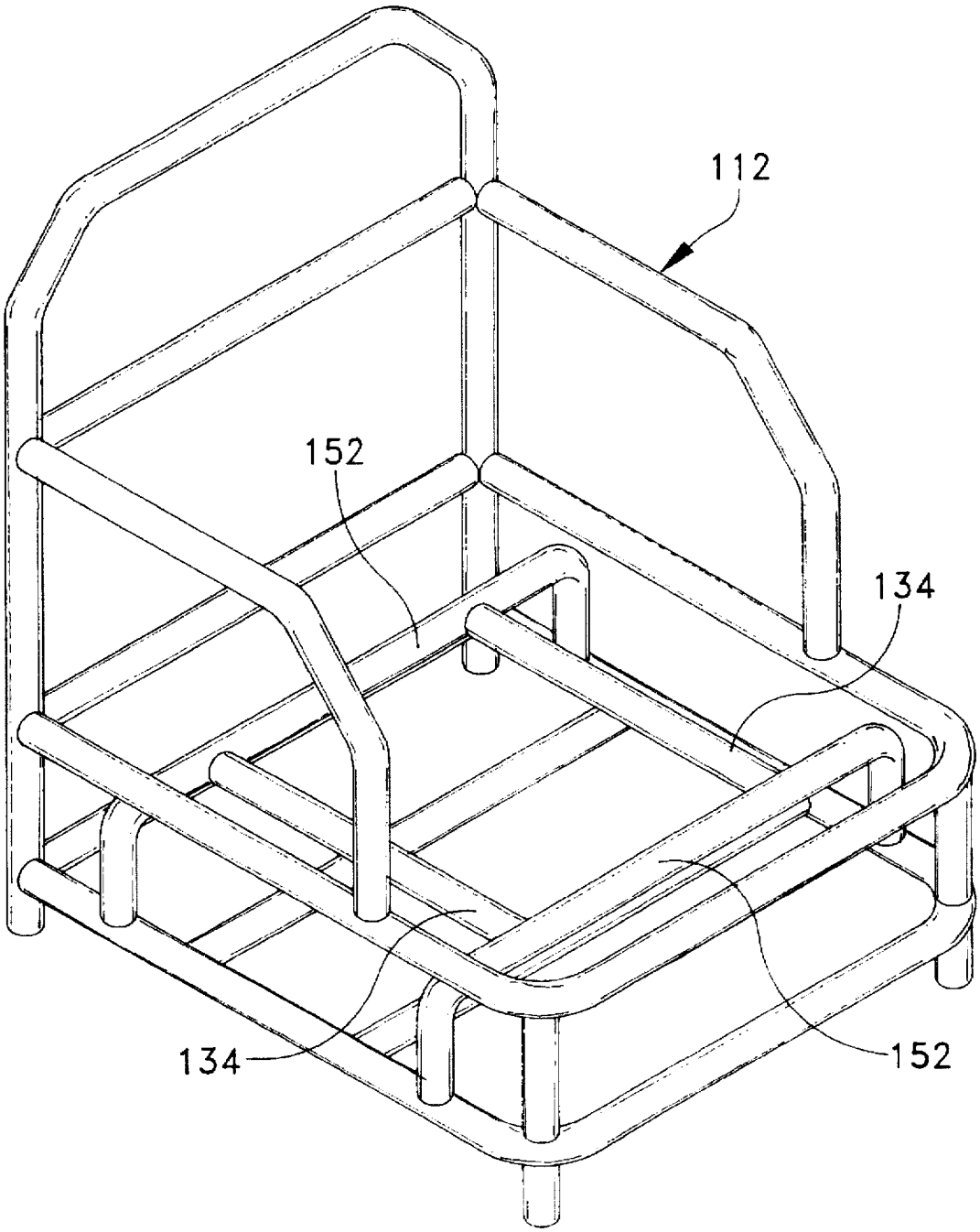
FIG. 10 is a perspective view of an alternative embodiment of a chair frame in accordance with the present invention.

In the alternative, chair frame 112 of FIG. 10 may be employed instead of chair frame 12 and box insert 14 arrangement as shown in FIG. 2. Chair frame 112 includes integral cross-arms 152 and stop members 134. Stop members 134 function in similar fashion to the stops 34 shown in FIGS. 2 and 5.

Figure 11:
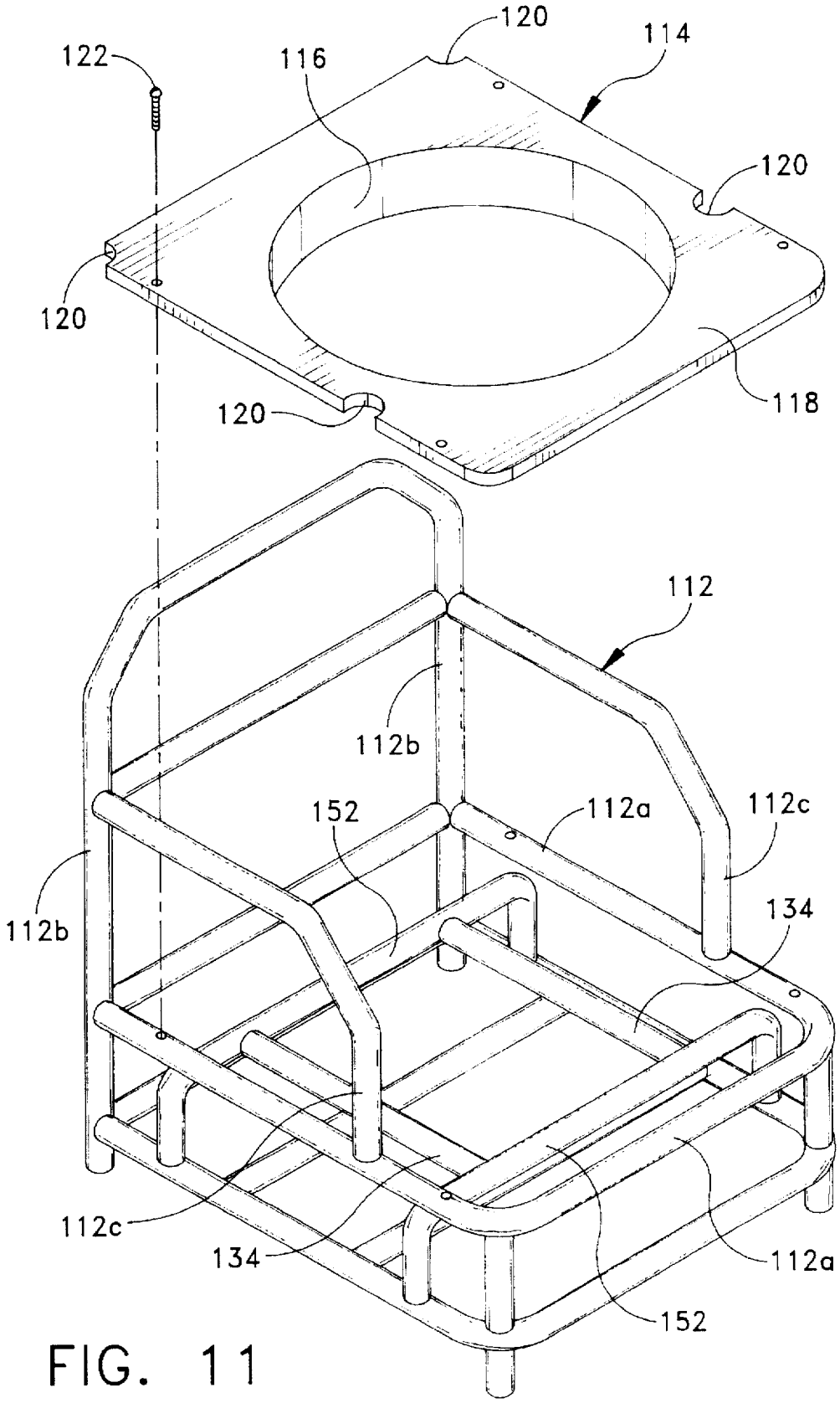
FIG. 11 is an exploded perspective view of an alternative embodiment of the present invention employing the frame of FIG. 10.
Figure 12:
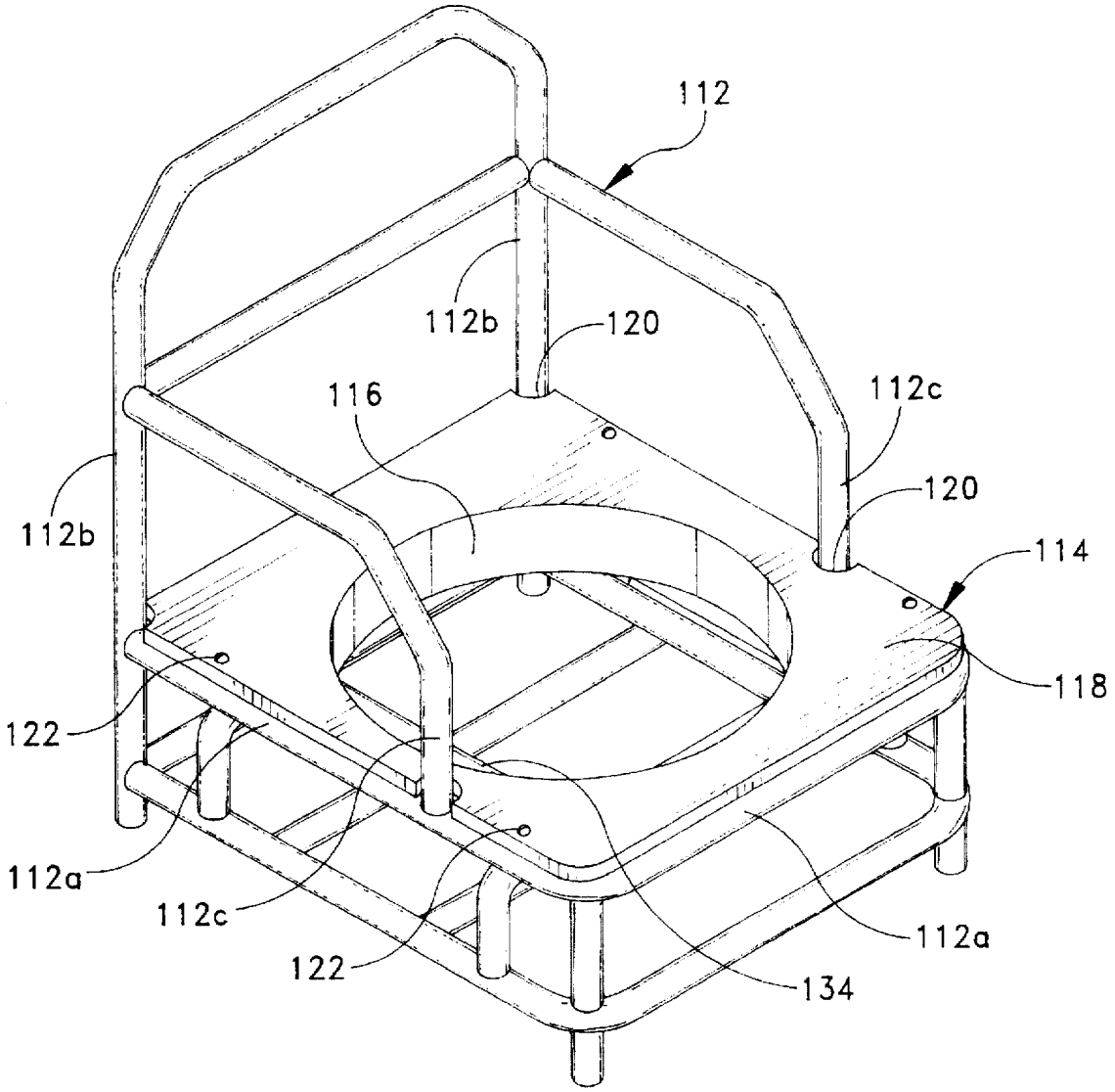
FIG. 12 is a perspective view of the alternative embodiment of the present invention in assembled form.

FIG. 11 shows an exploded perspective view of chair frame 112 with alternative insert 114 with central hole 130 for receiving flexible compression bag 20 in similar fashion to the embodiment shown in FIG. 2. Cylindrical wall 116 downwardly depends from planar member 118 to contain flexible compression bag 20 when it is installed in hole 130. Referring both to FIGS. 11 and 12, notches 120 permit close installation of insert 114 to arms **112*c* and poles 112*b* on horizontal tubes 112*a*. Screws 122 secure insert 114 to horizontal tubes 112*a*. Alternative insert 114** may be manufactured of plastic material, or the like.

It would be appreciated by those skilled in the art that various changes and modifications can be made to the illustrated embodiments without departing from the spirit of the present invention. All such modifications and changes are intended to be covered by the appended claims.

What is claimed is:

1. A therapeutic medical chair for patients, comprising:

a chair frame having a bottom support surface with an aperture therein;

a compression member disposed in said aperture; said compression member including an enclosed flexible bag having a top and a bottom; a septum, disposed within and connected to said flexible bag, dividing said flexible bag into an upper chamber and a lower chamber; said septum including at least one aperture therethrough; a plurality of substantially spheroid members freely movable within said upper chamber and said lower chamber; said spheroid members being capable of migrating from said upper chamber to said lower chamber and from said lower chamber to said upper chamber via said at least one aperture;

a cushion assembly positioned on said compression member and constrained by said chair frame; and whereby the exertion of pressure on said cushion assembly, from a patient sitting thereon, urges said spheroid members to migrate in a downward direction from said upper chamber to said lower chamber via said at least one aperture thus gradually altering the position and configuration of said cushion assembly; said compression member being capable of being flipped over to start a new cycle and reverse the migration of spheroid members.

2. The therapeutic medical chair of claim 1, wherein said spheroid members are plastic beads.

3. The therapeutic medical chair of claim 1, further comprising:

a flange member affixed to and extending out from said flexible bag; said flange being positioned about the periphery of said flexible bag and substantially along the lateral centerline of the flexible bag;

at least one stop member connected to said chair frame;

said flange member removably resting on said at least one stop member to vertically position and secure said flexible bag.

4. The therapeutic medical chair of claim 1; wherein said septum is made of rubber.

5. The therapeutic medical chair of claim 1, wherein said chair frame is made of PVC.

6. The therapeutic medical chair of claim 1, wherein said cushion assembly is a bean bag.

7. The therapeutic medical chair claim 1, further comprising:

upper strap means affixed to the top of said flexible bag for lifting said flexible bag; and bottom strap means affixed to the bottom of said flexible bag for lifting said flexible bag.

8. A therapeutic medical chair for patients, comprising:

a chair frame having a bottom support surface;

a flexible compression bag having a top and a bottom;

a septum, disposed within and connected to said flexible compression bag, dividing said flexible compression bag into an upper chamber and a lower chamber; said septum including at least one aperture therethrough;

a plurality of substantially spheroid members freely movable within said upper chamber and said lower chamber; said spheroid members being capable of migrating from said upper chamber to said lower chamber and from said lower chamber to said upper chamber via said at least one aperture;

a flange member affixed to and extending out from said flexible compression bag; said flange being positioned about the periphery of said flexible compression bag and substantially along the lateral centerline of said flexible compression bag;

a stop member connected to said chair frame and capable of communication with said flange member;

said flange member removably resting on said stop member to longitudinally position said flexible compression bag within said aperture;

a bean bag assembly positioned on said compression member and constrained by said chair frame; said bean bag containing a flowable filler media; and whereby the exertion of pressure on said cushion assembly, from a patient sitting thereon, urges said spheroid members to migrate in a downward direction from said upper chamber to said lower chamber via said at least one aperture thus gradually altering the position and configuration of said cushion assembly; said compression member being capable of being flipped over to start a new cycle and reverse the migration of spheroid members.

9. The therapeutic medical chair of claim 8, wherein said spheroid members are plastic beads.

10. The therapeutic medical chair of claim 8, wherein said filler media is plastic beads.

11. The therapeutic medical chair of claim 8, wherein said septum is made of rubber.

12. The therapeutic medical chair of claim 8, wherein said chair frame and stop member are made of PVC.

13. The therapeutic medical chair of claim 8, further comprising:

an upper strap affixed to the top of said flexible compression bag; and an bottom strap affixed to the bottom of said flexible compression bag.

* * * * *